US006126043A

United States Patent [19]

Albert, II

[11] Patent Number: 6,126,043

[45] Date of Patent: Oct. 3, 2000

[54] REUSABLE PORTABLE PRESSURIZED FLUID CONTAINER

[76] Inventor: William D. Albert, II, 6450 Matilija Ave., Van Nuys, Calif. 91401

[21] Appl. No.: 09/406,299

[22] Filed: Sep. 24, 1999

[51] Int. Cl.[7] ..... B67D 5/00

[52] U.S. Cl. ..... 222/340; 222/340; 222/387; 222/559; 222/561

[58] Field of Search ..... 222/256, 1, 340, 222/386, 387, 513, 514, 559, 561

[56] References Cited

U.S. PATENT DOCUMENTS

| | | | |
|---|---|---|---|
| 1,342,450 | 6/1920 | Kost et al. | 222/340 |
| 1,363,602 | 12/1920 | Kost | 222/340 |
| 2,918,200 | 12/1959 | Libit | 222/561 |
| 3,132,772 | 5/1964 | Bristow | 222/387 |
| 3,715,062 | 2/1973 | Todd et al. | 222/340 |
| 3,747,812 | 7/1973 | Karman et al. | 222/387 |
| 3,901,414 | 8/1975 | Capra et al. | 222/340 |
| 3,951,310 | 4/1976 | Steimen | 222/95 |
| 4,077,494 | 3/1978 | Spaude et al. | 222/340 |
| 4,077,544 | 3/1978 | Malacheski et al. | 222/340 |
| 4,090,646 | 5/1978 | Dubiel et al. | 222/326 |
| 4,174,055 | 11/1979 | Capra et al. | 222/319 |
| 4,235,353 | 11/1980 | Capra et al. | 222/256 |
| 4,488,663 | 12/1984 | Hooper et al. | 222/340 |
| 4,850,516 | 7/1989 | Seager | 222/387 |
| 5,042,696 | 8/1991 | Williams | 222/340 |
| 5,238,150 | 8/1993 | Williams | 222/95 |
| 5,242,084 | 9/1993 | Jinotti | 222/103 |
| 5,285,966 | 2/1994 | Czech | 239/321 |
| 5,289,945 | 3/1994 | Stradder | 222/561 |
| 5,553,749 | 9/1996 | Oyler et al. | 222/129.1 |
| 5,620,114 | 4/1997 | Chalfa, Jr. | 222/561 |
| 5,685,456 | 11/1997 | Goldstein | 222/95 |
| 5,772,083 | 6/1998 | Joulia | 222/396 |

*Primary Examiner*—J. Casimer Jacyna
*Attorney, Agent, or Firm*—Ladas & Parry

[57] ABSTRACT

A reusable portable pressurized fluid container. A central housing cylinder for storing fluid has an inner diameter with piston tracks longitudinally located thereon. A spring is internally axially mounted along the inner diameter of the central housing cylinder. A piston rests on the spring for applying pressure against fluid stored in the central housing, the piston having a piston head with spring loaded piston locking buttons protruding radially therefrom, the piston having a handle to longitudinally withdraw the piston within the central housing cylinder such that the piston locking buttons travel along the piston tracks to permit compression of the spring by a user. A cap is affixed to the central housing cylinder. The cap has a fluid coupler mounted therein, the fluid coupler having fluid connecting channels located therein, the fluid connecting channels being linearly moveable within the cap upon depression or release of fluid release buttons coupled to a fluid release spring therebetween. A fluid inlet port is coupled to fluid input channels located within the cap and a fluid output port is coupled to fluid output channels located within the cap. The fluid coupler aligns the fluid input channels to the fluid output channel through the fluid connecting channels when the fluid release buttons are depressed to dispense fluid under pressure from within the central housing cylinder and out of the fluid output port.

8 Claims, 7 Drawing Sheets

FIG. 3
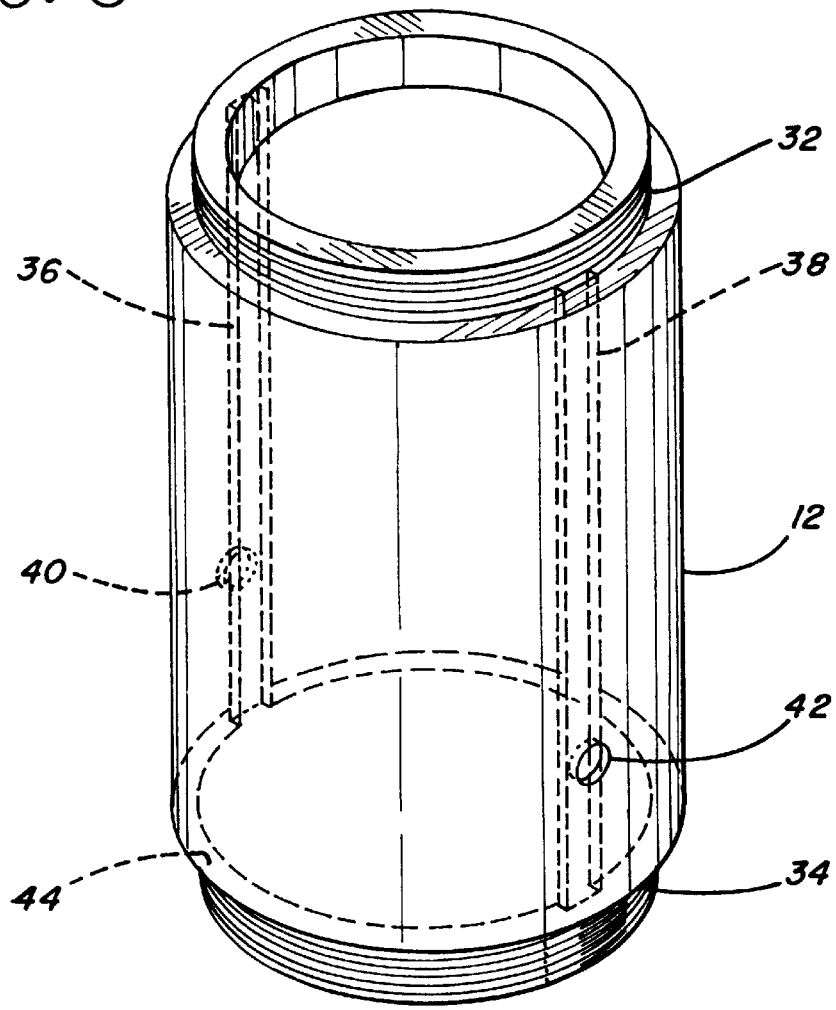
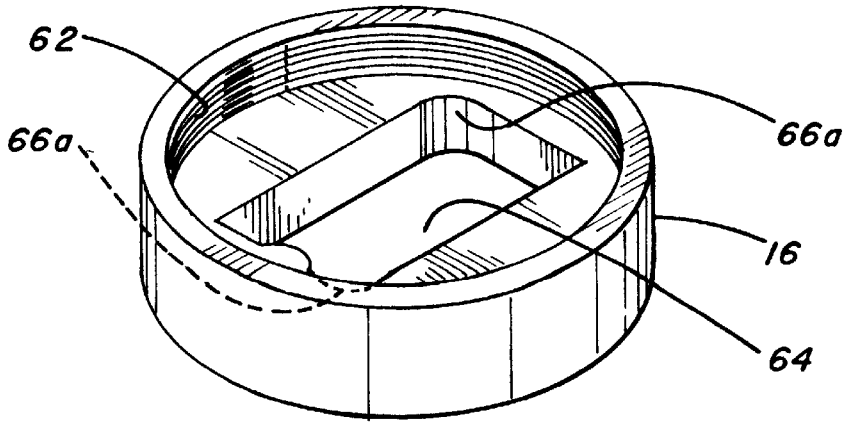
FIG. 6

FIG. 9A
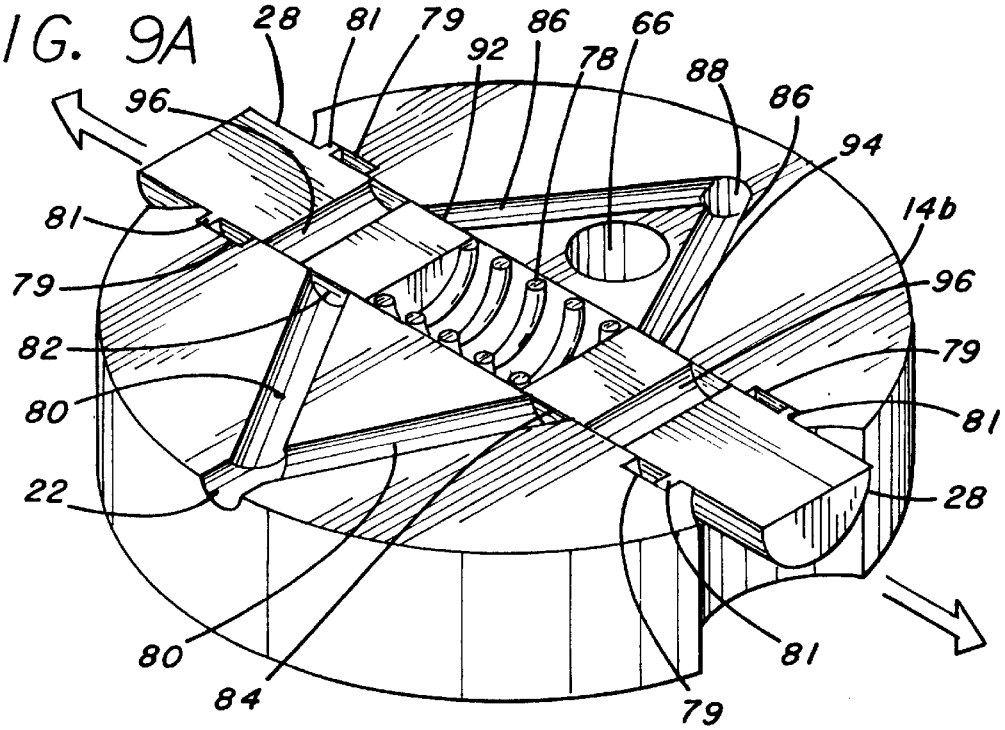
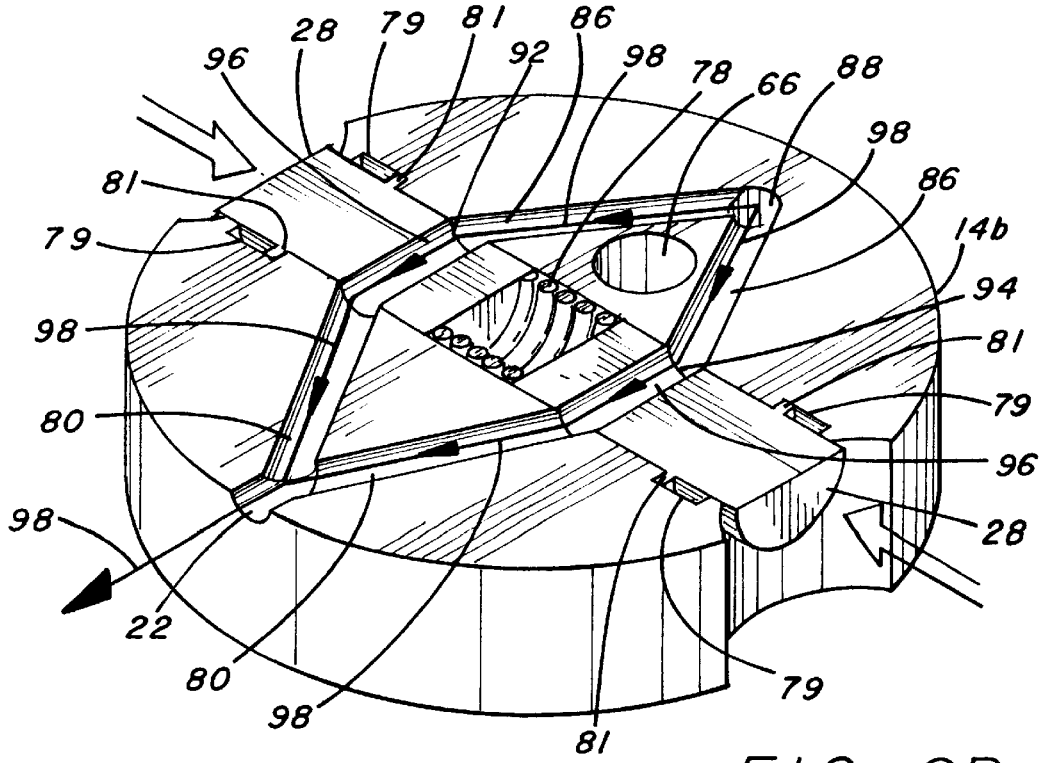
FIG. 9B

REUSABLE PORTABLE PRESSURIZED FLUID CONTAINER

FIELD OF THE INVENTION

This invention relates to the field of containers and, more particularly, to a portable pressurized fluid container useable by individuals for their personal consumption of fluids, such as water.

BACKGROUND OF THE INVENTION

Exercise programs undertaken by individuals, such as walking, jogging, bicycling, and the like have been growing in popularity in recent years. Such individuals during the course of such a jog/cycling many times desire to have periodic fluid intake, such as having a drink of water, to quench a thirst. Having a conveniently available source of such a fluid, such as a portable water bottle carried by a person or storably mounted on a bicycle for example, is very desirable.

Many current versions of such fluid containers are merely plastic bottles with a cap covering an opening area for dispensing of the fluid, some containing flexible straws affixable to the opening. However, when such containers are holstered to a jogger's waist, for example, they have a tendency to slosh water in partially filled bottles with each stride, lessening the enjoyment of the run and even interrupting concentration.

Other ways of dispensing fluids in a container involve well-known pressurized containers such as those disclosed in U.S. Pat. No. 3,951,310 issued to Steiman, involving a hand-held type aerosol dispenser including a bag which communicates with a can via a valve, in U.S. Pat. No. 4,090,646 issued to Dubiel et al. involving a dispenser for soft food having a piston threaded to the bottom end, a spring biased actuator, and a valve for opening and closing an outlet, in U.S. Pat. No. 4,174,055 issued to Capra et al. involving a non-aerosol pressurized dispenser having a chamber and a piston reciprocable therein, in U.S. Pat. No. 4,235,353 issued to Capra et al. involving a dispensing device for discharging material under pressure, in U.S. Pat. No. 5,238,150 issued to Williams involving a spray dispenser including a bellow and a piston, in U.S. Pat. No. 5,242,084 issued to Jinotti involving a fluid dispensing apparatus having two box-like chambers, a plastic bag, a drive plate and a plurality of springs disposed under the plate to apply pressure, in U.S. Pat. No. 5,285,966 issued to Czech involving a spraying apparatus having internal chamber selectively pressurized by a pressurizing device, in U.S. Pat. No. 5,553,749 issued to Oyler et al. involving a self-contained beverage dispensing system for dispensing both carbonated and non-carbonated mixed beverages, in U.S. Pat. No. 5,685,456 issued to Goldstein involving a regulated dispensing system having a coil spring made of a shape memory alloy and a pressure plate, and in U.S. Pat. No. 5,772,083 issued to Joulia involving a pressure relief system for a pressurized container.

However, each of these pressurized containers are relatively complex in structure and are not easily reusable. As such, there exists a need for a simple, economical, easy to use, re-useable portable pressurized fluid container. The present invention provides a method and apparatus to meet such needs.

SUMMARY OF THE INVENTION

In accordance with the present invention a method and apparatus for providing reusable portable pressurized fluid to a user is disclosed.

A central housing cylinder for storing fluid has an inner diameter with piston tracks longitudinally located thereon. A spring is internally axially mounted along the inner diameter of the central housing cylinder. A piston rests on the spring for applying pressure against fluid stored in the central housing, the piston having a piston head with spring loaded piston locking buttons protruding radially therefrom, the piston having a handle to longitudinally withdraw the piston within the central housing cylinder such that the piston locking buttons travel along the piston tracks to permit compression of the spring by a user. A cap is affixed to the central housing cylinder. The cap has a fluid coupler mounted therein, the fluid coupler having fluid connecting channels located therein, the fluid connecting channels being linearly moveable within the cap upon depression or release of fluid release buttons coupled to a fluid release spring therebetween. A fluid inlet port is coupled to fluid input channels located within the cap and a fluid output port is coupled to fluid output channels located within the cap. The fluid coupler aligns the fluid input channels to the fluid output channel through the fluid connecting channels when the fluid release buttons are depressed to dispense fluid under pressure from within the central housing cylinder and out of the fluid output port.

The reusable portable pressurized fluid container can further include the piston head being fluid sealable against the inner diameter of the central cylinder housing, and the piston tracks each having piston locking holes located therein such that when the piston is longitudinally withdrawn within the central housing cylinder the piston locking buttons engage the piston locking holes to secure the piston from moving within the central housing cylinder. The handle can be telescoping and a base can be provided for housing a grip of the handle when the handle is in a compressed telescoping position.

BRIEF DESCRIPTION OF THE DRAWINGS

FIG. 3 shows a perspective view of a central housing portion of an embodiment of the present invention.

FIG. 6. shows a perspective view of a base portion of an embodiment of the present invention.

FIG. 9A. shows a partial cross-section view of FIG. 8, taken along lines C—C, with fluid release buttons in an expanded position.

FIG. 9B. shows a partial cross-section view of FIG. 8, taken along lines C—C, with fluid release buttons in an contracted position.

DETAILED DESCRIPTION

Figure 1:
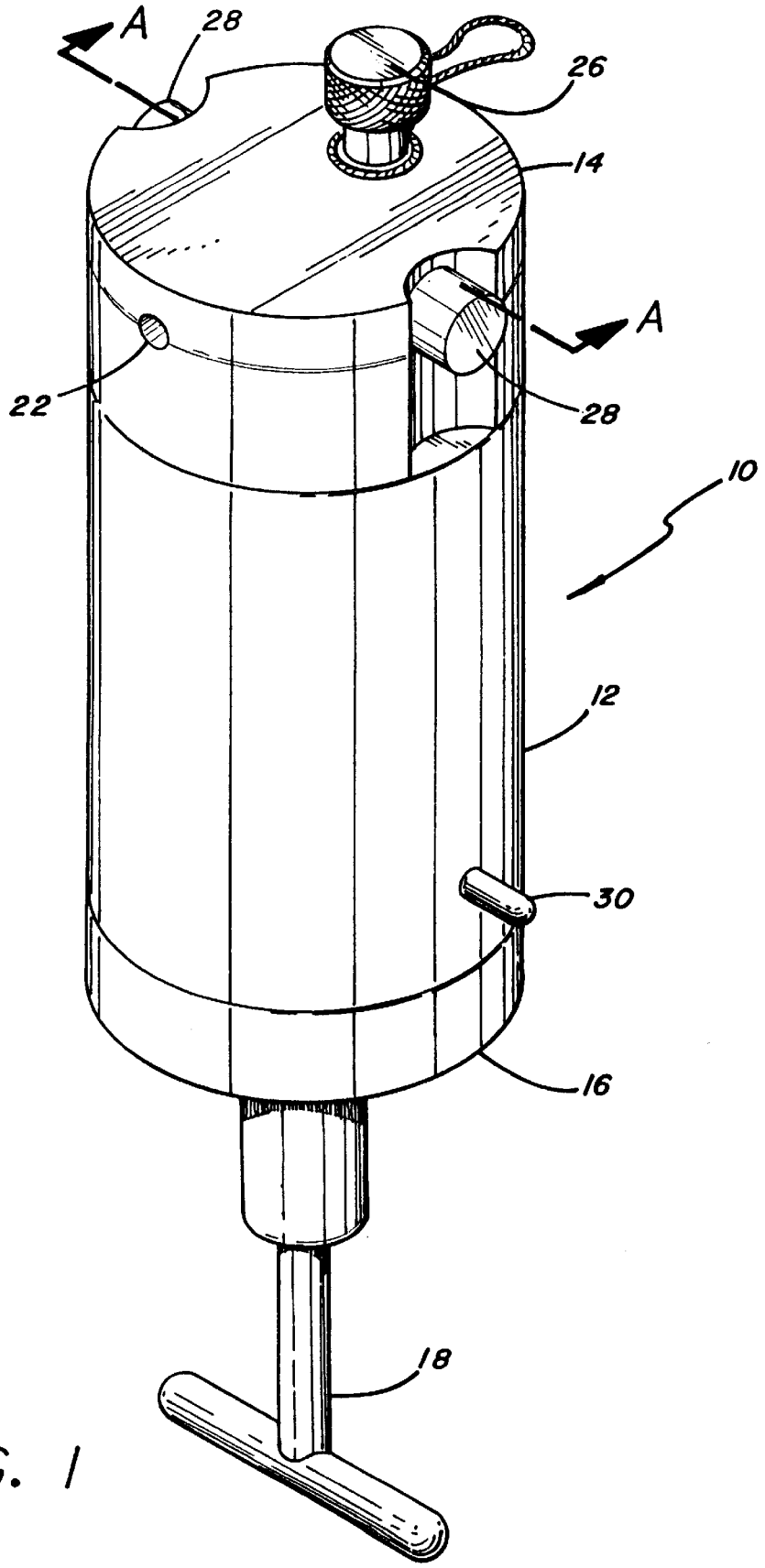
FIG. 1 shows an external perspective view of an embodiment of the present invention, with the telescoping handle extended from the base.
Figure 2:
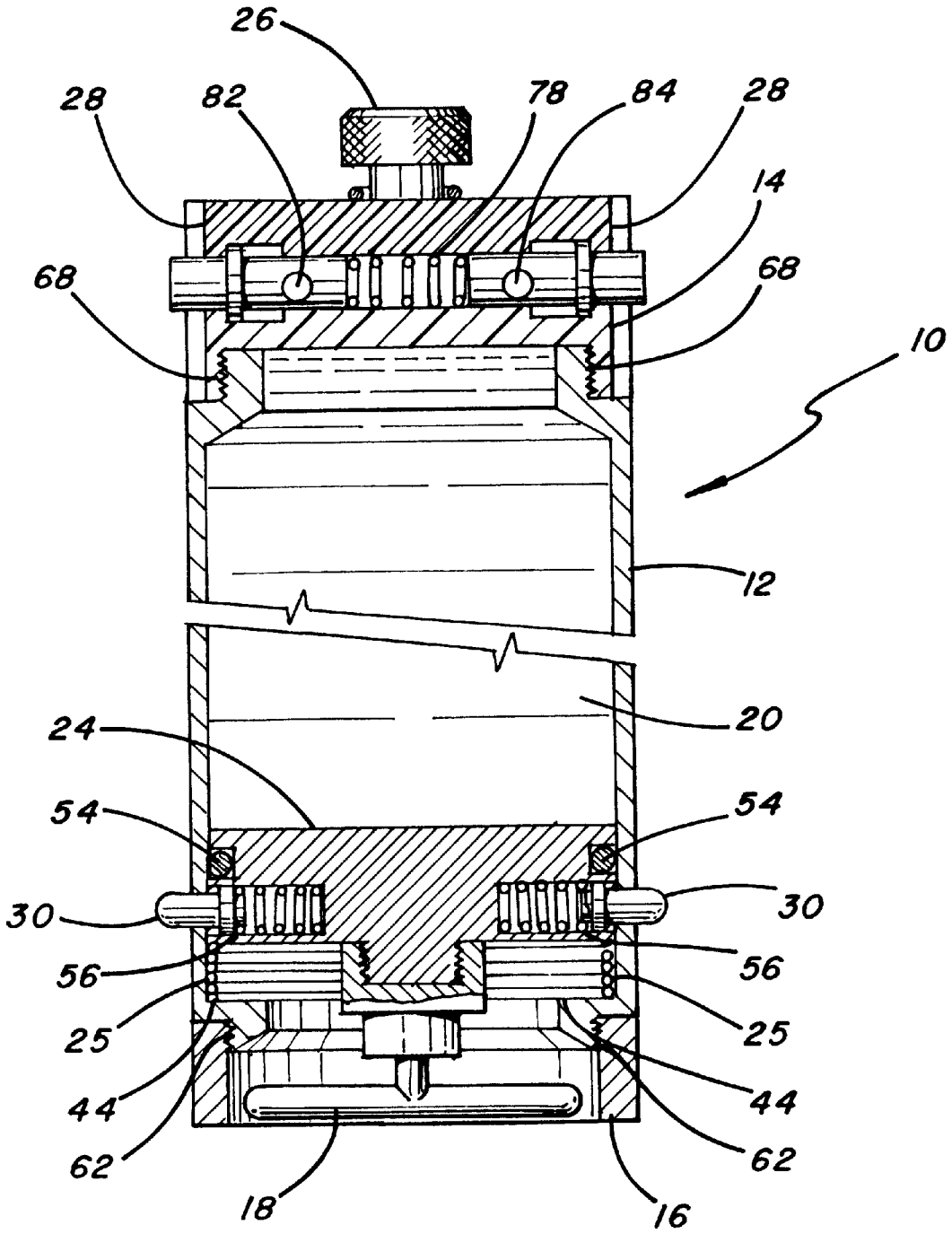
FIG. 2 shows a cross-section of FIG. 1, taken along lines A—A, with the telescoping handle depressed with the base.

Referring to FIGS. 1 and 2, there is shown a preferred embodiment of the present invention. Fluid container 10 includes central housing 12, cap 14, base 16, and telescoping piston assembly 18. In essence, central housing 12 holds a fluid 20 for dispensing to a user through fluid exit port 22 located on cap 14. Pressure is applied against fluid 20 by piston assembly 18 at piston head 24 using spring 25. Cap 14 also includes filler port 26 and fluid release buttons 28, to be described in more detail below. Central housing 12 also includes piston locking buttons 30, to be described in more detail below.

Referring to FIG. 3, central housing 12 is shown in more detail. Central housing 12 is a plastic cylinder approximately 8½" in length, 3" in outer diameter, and having approximately 0.015" wall thickness. At one longitudinal end cap threads 32 are provided. At the opposite longitudinal end base threads 34 are provided. Longitudinally along the inner surface at opposite points on a diameter inner tracks 36, 38 are formed, having width and depth dimensions of 5/32", respectively. Piston locking holes 40, 42, formed through the wall of central housing 12 and are located in each of the inner tracks 36, 38, approximately ⅓ of the length of the cylinder from the base end. Locking holes 40, 42 are sized to accept locking buttons 30. Cylinder housing 12 also includes spring shoulder 44 which supports spring 25 when assembled. Spring 25 is sized to provide 15 lbs pressure when compressed.

Figure 4:
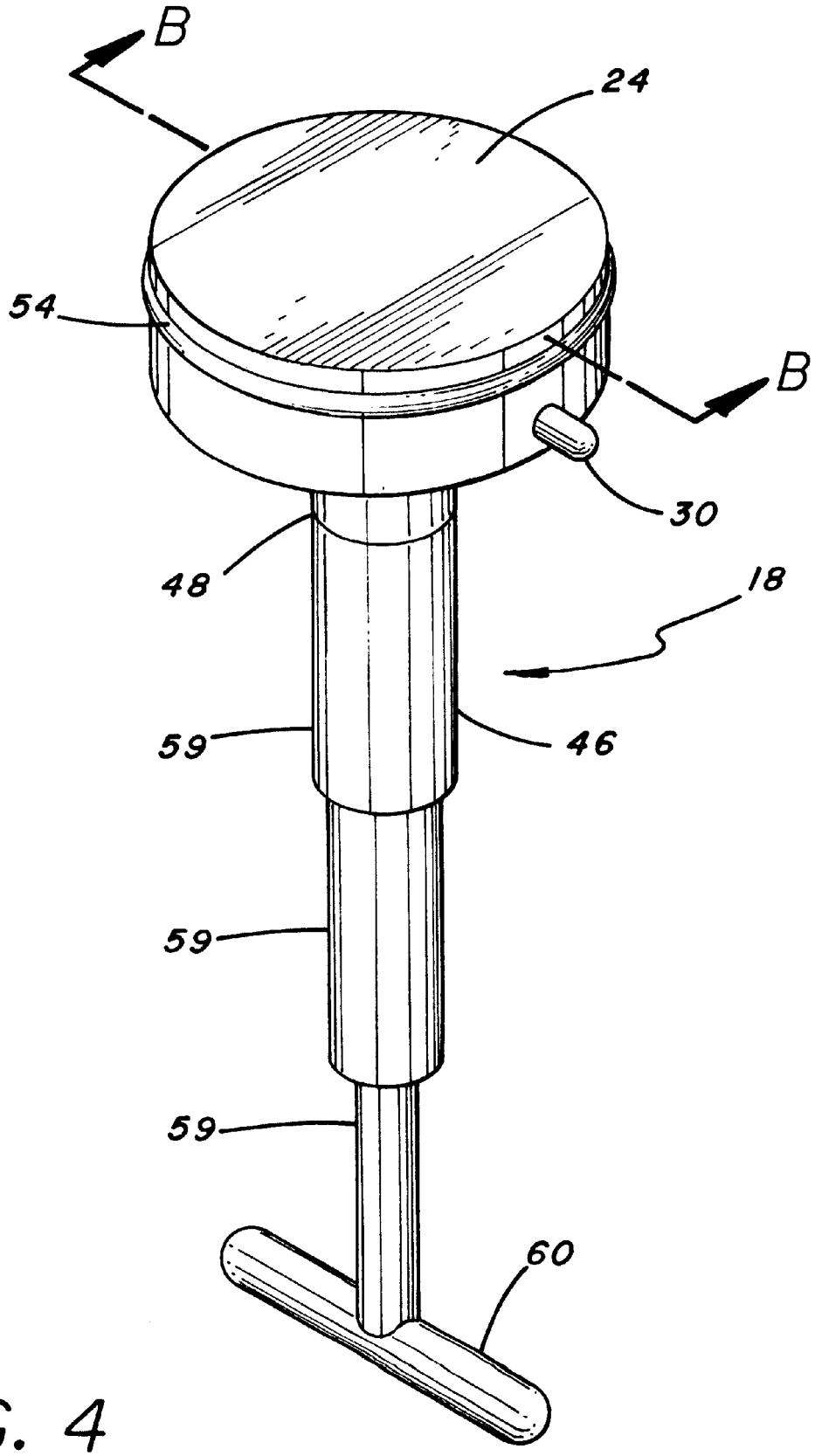
FIG. 4. shows a perspective view of a piston assembly portion of an embodiment of the present invention.
Figure 5:
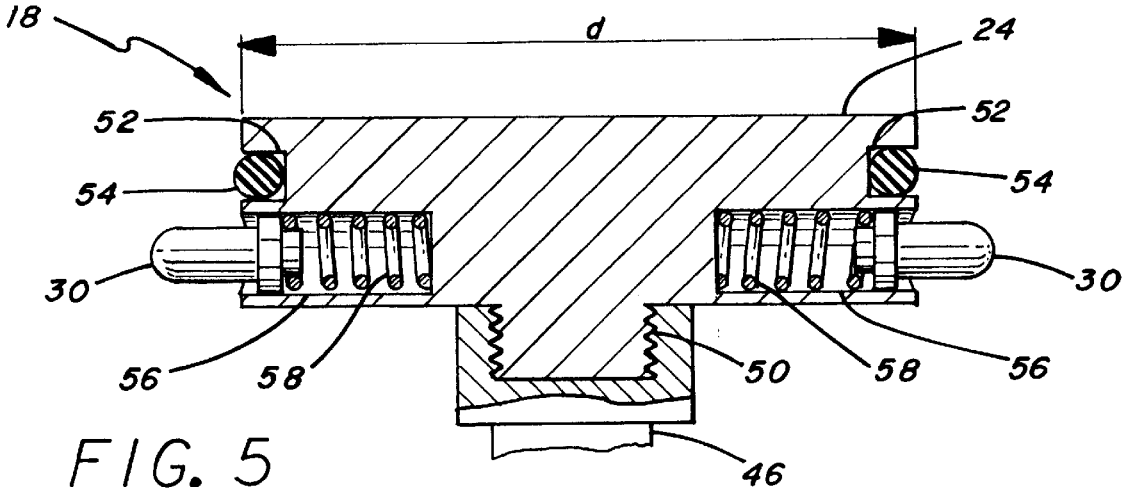
FIG. 5. shows a partial cross-section of FIG. 4, taken along lines B—B.

Referring to FIGS. 4 and 5, piston assembly 18 is shown in more detail. Piston assembly 18 is made of plastic includes piston head 24 and telescoping handle 46 which are joinable at junction 48 by an external thread 50 on one longitudinally external end of handle 46 and a corresponding internal thread in piston head 24. Piston head 24 has an outer diameter d sized to slide with the inner diameter of central housing 12. Piston head 24 includes external o-ring groove 52 which houses o-ring 54. O-ring 54 is sized to allow piston head 24 to slide within central housing 12, while provided a fluid seal between piston head 24 and central housing 12. Piston head 24 includes locking button support holes 56 which house locking button springs 58. Locking button springs 58 are affixed into locking button support holes and penetrate into an inner recess of locking button 30. Telescoping handle 46 has standard telescoping cylinders 59 and includes grip 60 sized to enable a user's fingers to grasp grip 60 and allow the expanding and contracting of the telescoping mechanism.

Figure 7:
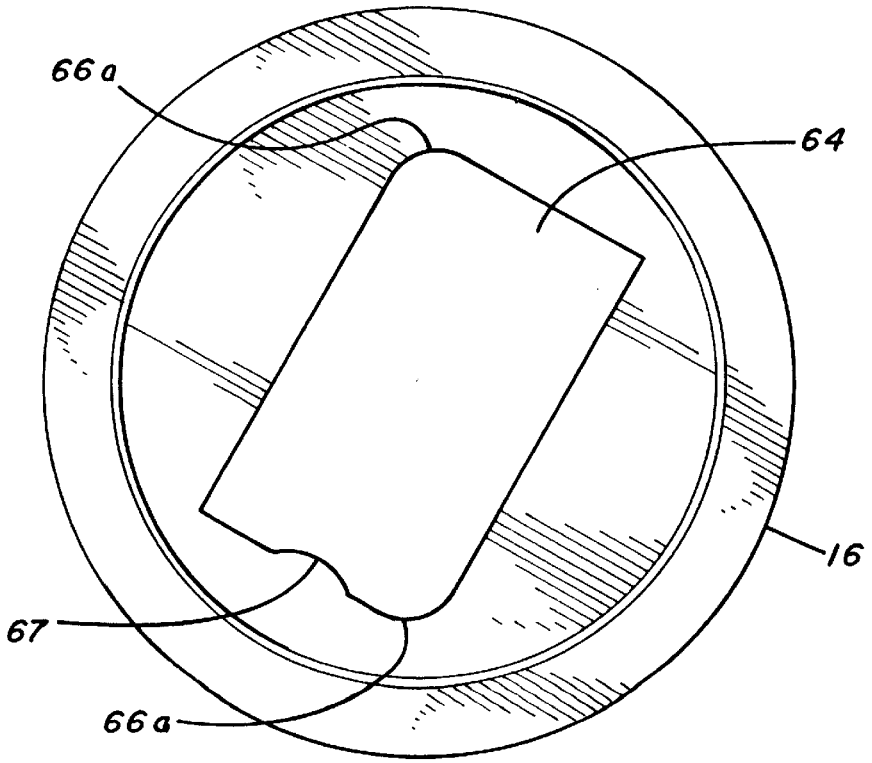
FIG. 7. shows a bottom view of a base portion of an embodiment of the present invention.

Referring to FIGS. 2, 6 and 7 base 16 is described in more detail. Base 16 is made of plastic and has internal threads 62 which accept external threads 34 of central housing 12. Base 62 has inner clearance area 64 through which grip 60 of piston assembly 18 passes when telescoping and is housed when telescoping sections 59 are in a fully closed position. Inner clearance area 64 can include a pair of rounded corners 66*a* sized to fit the external ends of grip 60 and allow grip 60 to be secured in place when turned within clearance area 64. An optional locking bump 67 can be provided along an inner edge of clearance area 64 such that grip 60 can be moved axially and pass over locking bump 67 when moved into rounded comers 66*a*.

Figure 8:
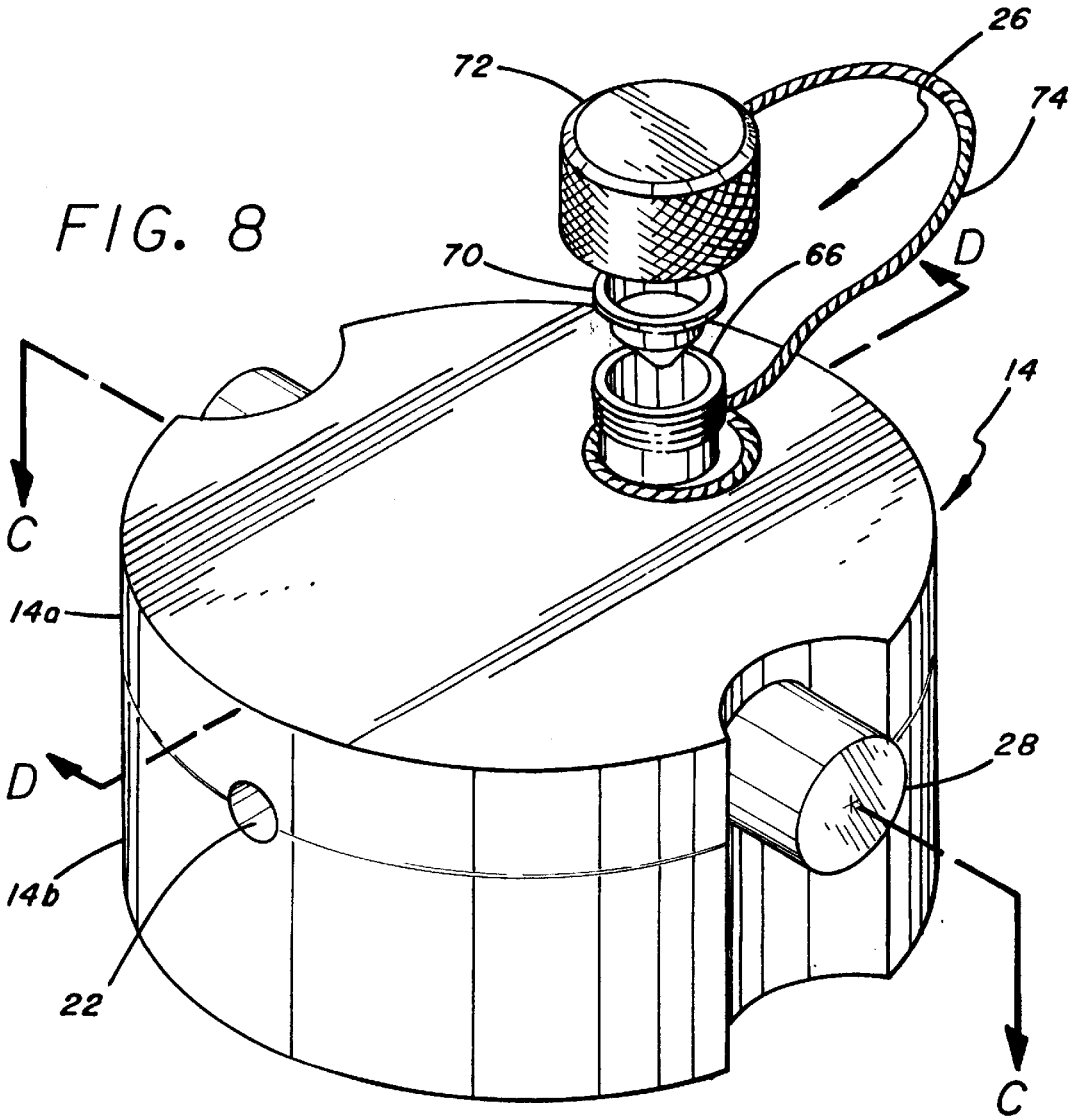
FIG. 8. shows an exploded perspective view of a cap portion of an embodiment of the present invention.

Referring to FIGS. 2 and 8 cap 14 is described in more detail. Filler port 26 includes threaded filler mouth 66 mounted on cap 14. Filler mouth 66 is a clearance hole that allows fluid to be inserted into the cylinder housing when cap 14 is mounted onto cylinder housing 12 using inner threads 68 to screw-couple with external threads 32 of cylinder housing 12. Filler mouth 66 accepts and mounts standard check valve 70 which helps prevent vacuum lock. Filler cap 72 can be threaded onto threaded filler mouth 66 to close port 26 when filling use is not being undertaken. Optional cap coupling 74 can be affixed to filler cap 72 and cap 14 to allow filler cap 72 to be in close proximity when filling port 26 is opened during filling.

Figure 10:
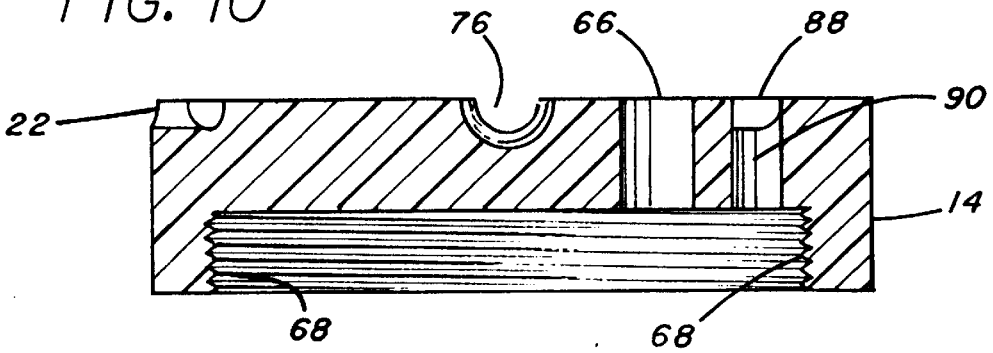
FIG. 10. shows a partial cross-section view of FIG. 8, taken along lines D—D.

Referring to FIGS. 9A, 9B and 10, the fluid dispenser portion of cap 14 is described in more detail. FIG. 9A shows in partial cross-section fluid release buttons 28 in an spring-expanded position, while FIG. 9B shows in partial cross-section fluid release buttons 28 in a spring-contracted position. Fluid release buttons 28 are slidably housed in a cylindrical shaft 76, with spring 78 therebetween. Stop slots 79 are formed in cap 14 to accept and allow sliding therein of button wings 81. Stop slots 79 in conjunction with button wings 81 allow movement of fluid release buttons 28 within cylindrical shaft 76 without fluid release buttons 28 falling out of the cap upon spring 78 being extended. A first pair of fluid dispense channels 80 intersect with fluid exit port 22 located in the side wall of cap 14 and with cylindrical shaft 76 at points 82, 84. A second pair of fluid dispense channels 86 intersect with fluid inlet hole 88 whose hole shaft 90 permits fluid 20 under pressure in housing 12 to enter fluid dispense channels 86. Dispense channels 86 also intersect with cylindrical shaft 76 at points 92, 94. Release buttons 28 each contain connection channels 96. Connection channels 96 and dispense channels 80, 86 are all of the same diameter, namely 5/32". As can be seen when comparing FIGS. 9A and 9B, when fluid release buttons 28 are not depressed, i.e., pushed inward towards the center of cap 14, spring 78 pushes against release buttons 28 such that connecting channels 92 are not aligned with fluid dispense channels 80, 86. However, when fluid release buttons are depressed, spring 78 contracts such that connecting channels 92 are aligned with fluid dispense channels 80, 86. As such, when the fluid release buttons are depressed, fluid 20 under pressure can flow into hole shaft 90, through fluid dispense channels 86, into connecting channels 96, through fluid dispense channels 80 and out through fluid exit port 22. Fluid path 98 depicts the pressurized water flow in FIG. 9B.

Referring back to FIGS. 2, 3, 4 and 9A–9B, the preferred embodiment is assembled and operates as follows. Spring 25 is placed within central housing 12 seating on spring shoulder 44. O-ring 54 is placed on piston head 24. Piston locking buttons 30, with locking button springs therein are secured within locking button support holes 56. Piston assembly 18 is inserted into central housing 12 such that piston locking buttons 30 are depressed and slide along inner tracks 36, 38. Grip 60 of telescoping handle 46 is pulled so that telescoping cylinders 59 expand longitudinally to permit piston locking buttons 30 to engage and protrude from locking holes 40, 42, compressing spring 25. Base 16 can be threaded onto threads 34 of central housing 12 and allow telescoping handle 46 to be depressed and secured within base 16.

Cap 14, is formed from upper half 14*a* and lower half 14*b*, which are secured together (e.g., by gluing) to form cap 14. The lower half only is shown in FIGS. 9A and 9B. Preassembled spring 78 having fluid release buttons 28 attached thereto, is inserted in cylindrical shaft 76 such that button wings 81 fit within stop slots 79. Upper half 14*a* of cap 14 can then be secured to its counterpart lower half 14*b*, sandwiching preassembled spring 78 centrally within cylindrical shaft 76. Check valve 70 is placed into and seated in filler mouth 66. Cap 14 is then threaded onto threads 32 of central housing 12. Fluid container 10 is now ready for use.

With filler cap 72 disengaged from filler mouth 66, fluid 20 to be placed into fluid container 10 is inserted into filler mouth 66 in an amount as desired. Locking buttons 30 are simultaneous depressed to allow spring 25 to apply pressure onto piston head 24 and allow piston head 24 to apply pressure to fluid 20 causing fluid 20 to flow up through fluid inlet hole 88 and into fluid dispense channels 86. Since fluid release buttons 28 are not depressed at this point, the body of fluid release buttons 28 block the fluid flow at points 92, 94. When a user desires to have fluid 20 dispensed from fluid exit port 22, the user manually depresses release buttons 28 such that connection channels 96 align with dispense channels 80, 86 allowing fluid 20 under pressure to exit fluid exit port 22. When the user desires no further fluid dispensing, he releases the depressed release button 28 such that connection channels 96 are again disaligned with dispense channels 80, 86. When the stored fluid is depleted such that spring 25 cannot force fluid 20 to be dispensed, the filling and use cycle can be repeated by the user.

Those skilled in the art can appreciate that various alternatives can be used to practice the present invention. For example, multiple fluid exit ports can be employed so that different types of fluid flow can be provided, such as a mist, small stream, wide spray stream, etc. Tubes and/or nozzles could be attached to the exit port. Various sizes, shapes, and materials can be implemented. A carrying strap or harness could be affixed to or around the container for carrying by a user. The cap or base could be molded as part of and forming a uni-body central housing/cap or uni-body central housing/base.

What is claimed is:

1. A reusable portable pressurized fluid container comprising:

a central housing cylinder for storing fluid, the central housing cylinder having an inner diameter with piston tracks longitudinally located thereon;

a spring internally axially mounted along the inner diameter of the central housing cylinder;

a piston resting on the spring for applying pressure against fluid stored in the central housing, the piston having a piston head with spring loaded piston locking buttons protruding radially therefrom, the piston having a handle to longitudinally withdraw the piston within the central housing cylinder such that the piston locking buttons travel along the piston tracks to permit compression of the spring by a user; and a cap affixed to the central housing cylinder, the cap having a fluid coupler mounted therein, the fluid coupler having fluid connecting channels located therein, the fluid connecting channels being linearly moveable within the cap upon depression or release of fluid release buttons coupled to a fluid release spring therebetween, a fluid inlet port coupled to fluid input channels located within the cap, a fluid output port coupled to fluid output channels located within the cap, and wherein the fluid coupler aligns the fluid input channels to the fluid output channel through the fluid connecting channels when the fluid release buttons are depressed to dispense fluid under pressure from within the central housing cylinder and out of the fluid output port.

2. The reusable portable pressurized fluid container of claim 1 wherein:

the piston head is fluid sealable against the inner diameter of the central cylinder housing, and the piston tracks each have piston locking holes located therein such that when the piston is longitudinally withdrawn within the central housing cylinder the piston locking buttons engage the piston locking holes to secure the piston from moving within the central housing cylinder.

3. The reusable portable pressurized fluid container of claim 1, wherein the handle is telescoping.

4. The reusable portable pressurized fluid container of claim 3, further comprising a base for housing a grip of the handle when the handle is in a compressed telescoping position.

5. A method of providing portable pressurized fluid to a user, comprising the steps of:

providing a central housing cylinder having an inner diameter with piston tracks longitudinally located thereon;

mounting a spring along the inner diameter of the central housing cylinder;

resting piston on the spring for applying pressure against fluid stored in the central housing, the piston having a piston head with spring loaded piston locking buttons protruding radially therefrom, the piston having a handle to longitudinally withdraw the piston within the central housing cylinder such that the piston locking buttons travel along the piston tracks to permit compression of the spring by a user; and affixing a cap to the central housing cylinder, the cap having a fluid coupler mounted therein, the fluid coupler having fluid connecting channels located therein, the fluid connecting channels being linearly moveable within the cap upon depression or release of fluid release buttons coupled to a fluid release spring therebetween, a fluid inlet port coupled to fluid input channels located within the cap, and a fluid output port coupled to fluid output channels located within the cap, wherein the fluid coupler aligns the fluid input channels to the fluid output channel through the fluid connecting channels when the fluid release buttons are depressed to dispense fluid stored under pressure from within the central housing cylinder and out of the fluid output port.

6. The method of providing portable pressurized fluid to a user of claim 5, further comprising the steps of:

fluid sealing the piston head against the inner diameter of the central cylinder housing, and providing the piston tracks with piston locking holes located therein such that when the piston is longitudinally withdrawn within the central housing cylinder the piston locking buttons engage the piston locking holes to secure the piston from moving within the central housing cylinder.

7. The method of providing portable pressurized fluid to a user of claim 5, wherein the handle is telescoping.

8. The method of providing portable pressurized fluid to a user of claim 7 further comprising the step of providing a base affixed to central housing cylinder for housing a grip of the handle when the handle is in a compressed telescoping position.

* * * * *